US007488061B2

(12) United States Patent
Putman

(10) Patent No.: US 7,488,061 B2
(45) Date of Patent: Feb. 10, 2009

(54) INK CARTRIDGE REPLACEMENT LID

(75) Inventor: William Allen Putman, Franklin, TN (US)

(73) Assignee: Nu-kote International, Inc., Franklin, TN (US)

( * ) Notice: Subject to any disclaimer, the term of this patent is extended or adjusted under 35 U.S.C. 154(b) by 0 days.

(21) Appl. No.: 11/131,087

(22) Filed: May 17, 2005

(65) Prior Publication Data

US 2006/0262170 A1 Nov. 23, 2006

(51) Int. Cl.
*B41J 2/175* (2006.01)

(52) U.S. Cl. ..... 347/86

(58) Field of Classification Search ..... 347/86–87
See application file for complete search history.

(56) References Cited

U.S. PATENT DOCUMENTS 5,408,256 A * 4/1995 Keen et al. ..... 347/87
5,631,682 A * 5/1997 Takata ..... 347/86
5,831,653 A * 11/1998 Brandon et al. ..... 347/87
6,161,927 A 12/2000 Long et al.
6,250,750 B1 * 6/2001 Miyazawa et al. ..... 347/87
6,736,486 B2 * 5/2004 Nakamura et al. ..... 347/49
6,935,730 B2 * 8/2005 Qingguo et al. ..... 347/86
6,953,242 B2 * 10/2005 Yoshiyama et al. ..... 347/86
2006/0238584 A1 * 10/2006 Putman ..... 347/86

* cited by examiner

*Primary Examiner*—Huan H Tran
(74) *Attorney, Agent, or Firm*—Fay Sharpe LLP

(57) ABSTRACT

An ink jet cartridge lid has a body having a first planar side and a second planar side opposite the first side. The first planar side has a raised portion having a first angled end wall and a second angled end wall. A third, side wall and a fourth, side wall each connect the first end wall to the second end wall of the lid. The second planar side has a recess therein with projections for compressing a foam insert. The lid is installed onto an ink jet cartridge having an open-ended cavity and a foam insert disposed therein.

31 Claims, 6 Drawing Sheets

INK CARTRIDGE REPLACEMENT LID

BACKGROUND OF THE INVENTION

Ink jet printers typically provide ink to the printhead through the use of ink jet cartridges. The cartridge provides a container in which printing ink is stored until used with the printheads. The ink jet cartridge is connected to the printhead so as to allow flow of ink from the cartridge to the printhead when needed.

Currently, ink jet cartridges include a main body which has a bottom and four side walls defining an ink cavity of the ink jet cartridge. A foam insert is then typically pressed into the body cavity of the cartridge, and the cavity and foam insert are then filled with ink by means of an open-ended top. Lastly, a cover or lid is placed on the now ink filled main body and attached to the side walls thereto.

Existing lids are typically configured to be used only with a particular printer. Different lids must be manufactured and installed on ink cartridges for each particular manufacturer's printer which can be time-consuming and costly. Thus, it is considered desirable to provide a lid design which is compatible with various style Original Equipment Manufacturer (OEM) printers.

SUMMARY OF THE INVENTION

This invention relates to cartridges for ink jet printers. More particularly, the invention relates to an improved closure lid design for an ink jet printer cartridge which can be used with various design printers.

In accordance with one aspect of the invention, an ink jet cartridge lid has a body having a first planar side; a second planar side opposite the first side, wherein the first planar side has a raised portion having a first angled end wall and a second angled end wall opposite the first wall. A recessed portion is formed on the second planar side.

In accordance with another aspect of the invention, an ink jet printer cartridge has an ink container body having a bottom wall and a plurality of side walls. The side walls each have a top wall edge. The bottom wall and the side walls together form a cavity. A body has a first planar side and a second planar side opposite the first planar side. The first planar side has a raised portion having a first angled end wall and a second angled end wall. At least one projection extends from the second planar side.

One aspect of the present invention is the provision of a cartridge lid which is conformed to be used with various style printers.

Another aspect of the present invention is the provision of a cartridge lid which retains all the functionality of an OEM cartridge.

Another aspect of the present invention is the provision of a venting system for venting the cartridge internal chamber to atmosphere.

Still other aspects of the invention will become apparent from a reading of the following description taken together with the accompanying drawings.

BRIEF DESCRIPTION OF THE DRAWINGS

Further aspects of the invention will become apparent by reference to the detailed description when considered in conjunction with the figures, wherein like reference numbers indicate like elements through the several views, and wherein.

DETAILED DESCRIPTION OF PREFERRED EMBODIMENTS

Figure 1:
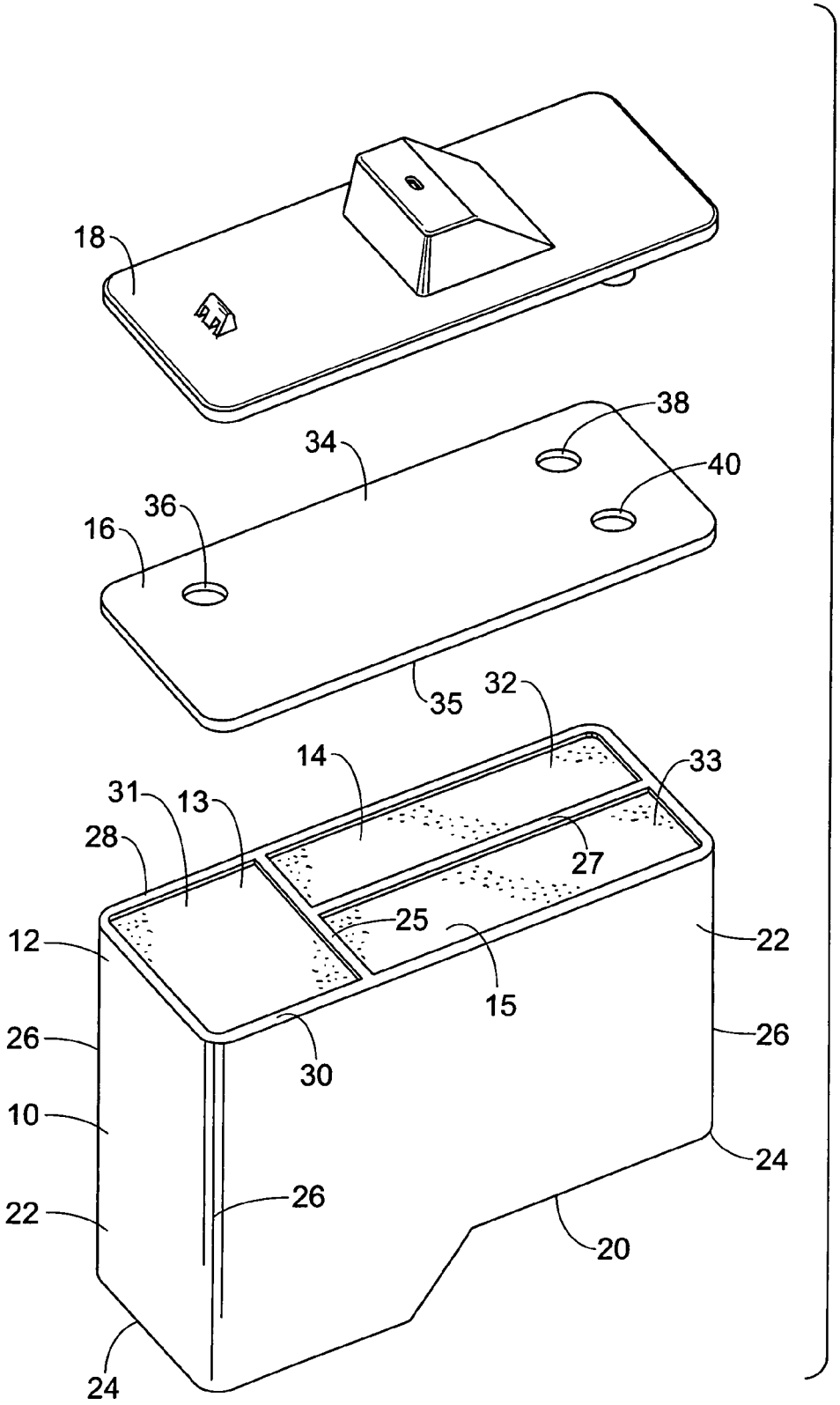
FIG. 1 is an exploded perspective view of an ink cartridge assembly according to the invention.
Figure 2:
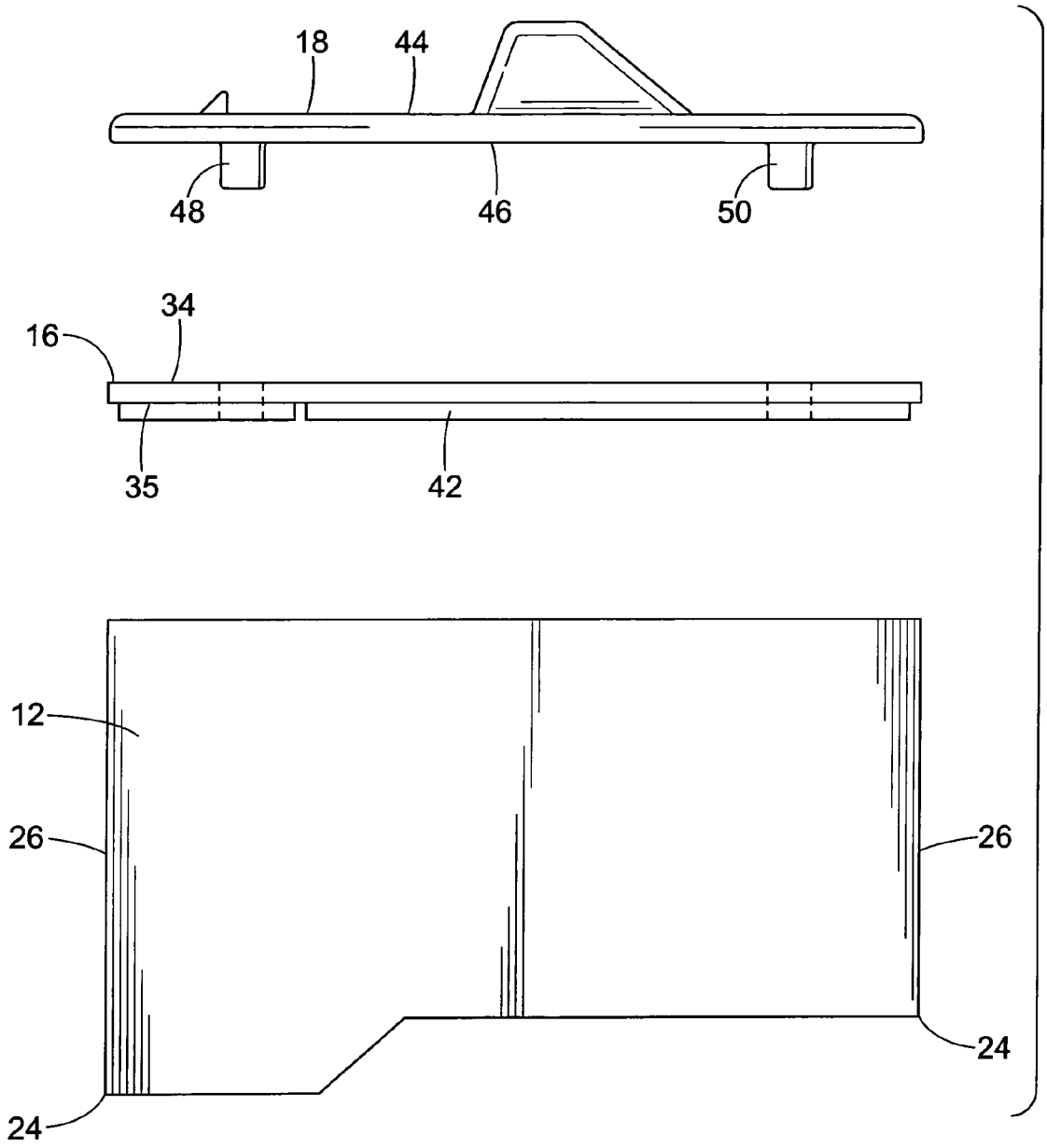
FIG. 2 is an exploded side elevational view of an ink cartridge assembly according to the invention.
Figure 3:
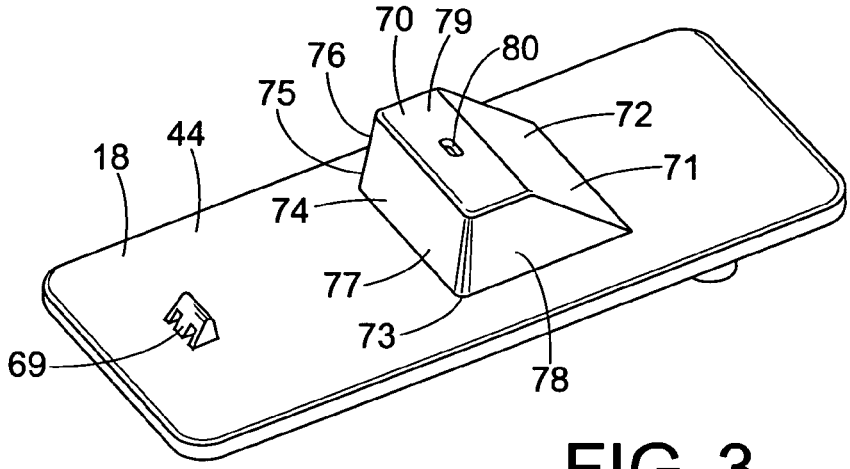
FIG. 3 is a perspective view of an ink container lid according to a first embodiment of the present invention.

With reference to FIGS. 1 and 2, there is shown an ink jet printer cartridge 10 in accordance with an embodiment of the present invention having an ink container body 12, a plurality of foam inserts or ink absorbing members 13, 14, 15 which are disposed within the ink container body, a spacing member or spacer 16 which is fixedly attached to the ink container body, and a cover or lid 18 which is fixedly connected to the spacing member 16.

The ink container body 12 serves as the storage receptacle for the foam inserts 13, 14, 15 and the printing ink contained therein. The ink reservoir may be constructed of any suitable material for liquid storage devices so long as the material does not react with the printing ink. The ink container body 12 is preferably constructed of a material which is both durable and lightweight, such as a thermoplastic material. The thermoplastic material may be formed by processes well known in the art such as injection molding, thermoforming, blow molding and the like.

As constructed, the ink container body 12 has a bottom portion 20 and four side portions 22. The side portions 22 serve as the side walls of the ink container body and have side wall bottom edges 24 and are joined to the bottom portion along these edges 24. The side portions also have side edges 26 along which the side portions are joined to one other. The side portions have top wall edges 28 which together define a reservoir periphery 30. The reservoir periphery 30 is of sufficient width and thickness as to provide a contact surface to which the spacer member 16 can later be fixedly attached.

The ink container body is generally in the shape of an open-faced prism, such as an open faced rectangular prism and has open-ended cavities 31, 32, 33, defined by the combination of the bottom portion 20, the side portions 22, the reservoir periphery 30 and partition walls 25 and 27. The cavities each have a generally cubical shape.

With reference still to FIG. 1, foam inserts 13, 14, 15 are disposed within the open-ended cavities 31, 32, 33 of the ink container body. The foam inserts or ink absorbing members act as sponges to absorb and wick printing ink within the ink jet printer cartridge. The ink absorbing members may be formed of any suitable spongelike material, such as a reticulated or open cell foam such as a polyurethane or melamine foam.

The shape and size of the ink absorbing member are determined in accord with the size and shape of the open-ended cavities 31, 32, 33 of the ink container body. Preferably the foam inserts are slightly larger than the shape and size of the open-ended cavities so that the foam inserts are compressed within the cavity.

The spacing member 16 is fixedly attached to the ink container body 12 along periphery 30. Like the ink container body 12, the spacing member is preferably formed from a lightweight, durable material such as a thermoplastic material.

The spacing member 16 has first and second sides 34, 35 and a plurality of holes or openings 36, 38, and 40 formed in and through the spacing member. The holes are used to fixedly connect the container lid to the spacing member and provide gas flow passage for pressure equalization in the cartridge. The spacing member is shown to have three holes; however, other numbers of holes can be used without departing from the scope of the present invention.

The spacing member is fixedly attached to the ink container body 12 preferably by ultrasonic welding. The spacing member 16 is positioned so that the second side 35 contacts the reservoir periphery 30 along the top wall edges 28 of the ink container body.

The spacing member and ink container body are preferably fixedly attached to one another by a welding technique such as ultrasonic welding which is well known in the art. Other methods of attachment such as use of adhesives, infrared welding, etc. can also be used to provide an adequate seal.

It will be appreciated that, since the fixed attachment of the spacing member 16 to the container body 12 substantially seals the open-ended cavities 31, 32, 33 except for the plurality of holes formed in the spacing member, the foam inserts must be disposed in the open-ended cavities before fixedly attaching the spacing member to the container body 12.

Referring now to FIG. 2, the spacing member can also have a plurality of ribs 42 which extend below the second side 35 of the spacing member and extends into the cavities of the container body 12 so as to contact and compress the foam inserts or ink absorbing members.

After the spacing member is fixedly attached to the container body, the cavities 31, 32, 33 of the container body and foam inserts are filled with a volume of printing ink. The printing ink may be any ink suitable for ink jet printing equipment including pigment and dye based inks. The ink may be colored ink such as cyan, magenta, or yellow or alternatively can be black ink as well. The ink is transferred into the cavities 31, 32, 33 of the container 12 by means of the plurality of holes 36, 38, 40 formed in the spacing member. A needle or syringe may be temporarily inserted through one or more of the holes to transfer ink to the cavities. A substantial portion of the ink transferred into the cavities is absorbed and retained within the porous material of the ink absorbing members 13, 14, 15.

Figure 4:
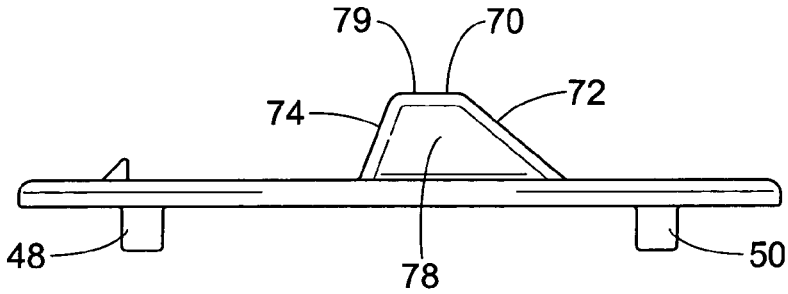
FIG. 4 is a side elevational view of the ink container lid of FIG. 3.

After filling the reservoir with ink, a container lid 18, in accordance with a first embodiment of the present invention, is fixedly connected to the spacing member 16. Referring to FIGS. 2 and 4, the container lid 18 has a generally planar first side 44 and a second side 46. When fixedly connected to the spacing member, the container lid 18 is positioned so that the second side 46 faces the first side 34 of the spacing member.

Figure 6:
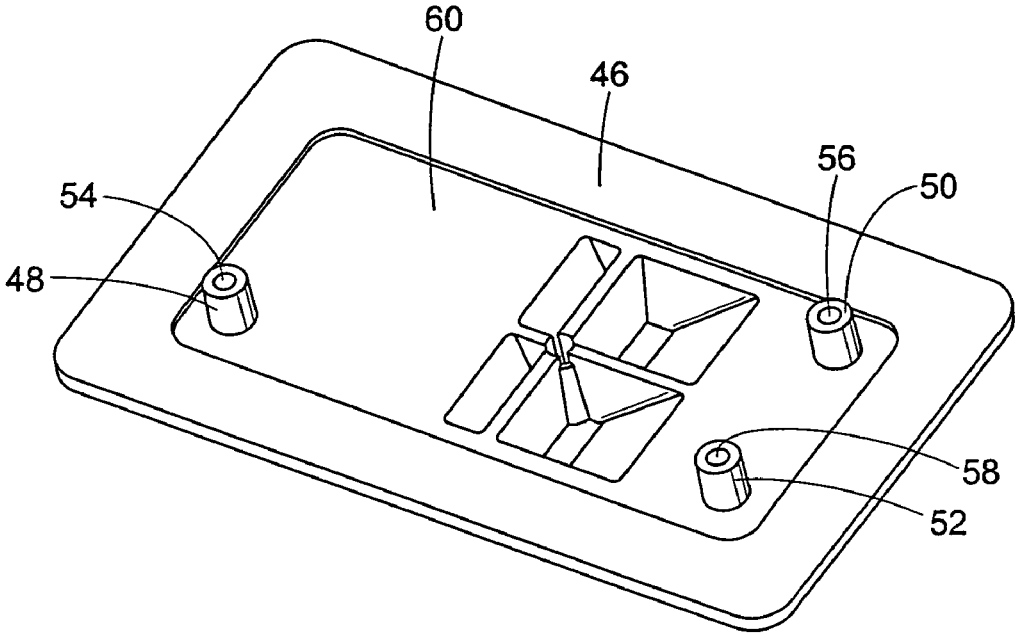
FIG. 6 is a bottom perspective view of the ink container lid of FIG. 3.

Referring now to FIG. 6, extending from the second side 46 of the container lid 18 is a plurality of projections in the form of connecting pegs or posts 48, 50, 52. The connecting posts are configured to nonhermetically engage the plurality of holes or openings 36, 38, 40 formed in the spacing member so as to fixedly connect the reservoir lid 18 to the spacing member. That is, the connecting posts 48, 50, 52 engage into the plurality of holes 36, 38, 40 in the spacing member sufficiently so that the container lid is fixedly connected to the spacing member as by friction between the outside surface of the posts and the inside circumferences of the holes in the spacing member.

Once attached to the spacing member, the lid 18 cannot be easily removed without applying substantial force between the spacing member and lid. However, the connecting posts 48, 50, 52 do not engage the holes 36, 38, 40 sufficiently to form an airtight seal between the holes and the connecting posts. Referring to FIG. 6, the bottom side 46 of the container lid is shown to have at least three connecting posts, one for each chamber, but may contain more or fewer connecting posts provided the spacing member has at least as many holes as there are posts and the number of posts are sufficient to provide a substantially non-removable connection between the lid and spacing member.

Figure 5:
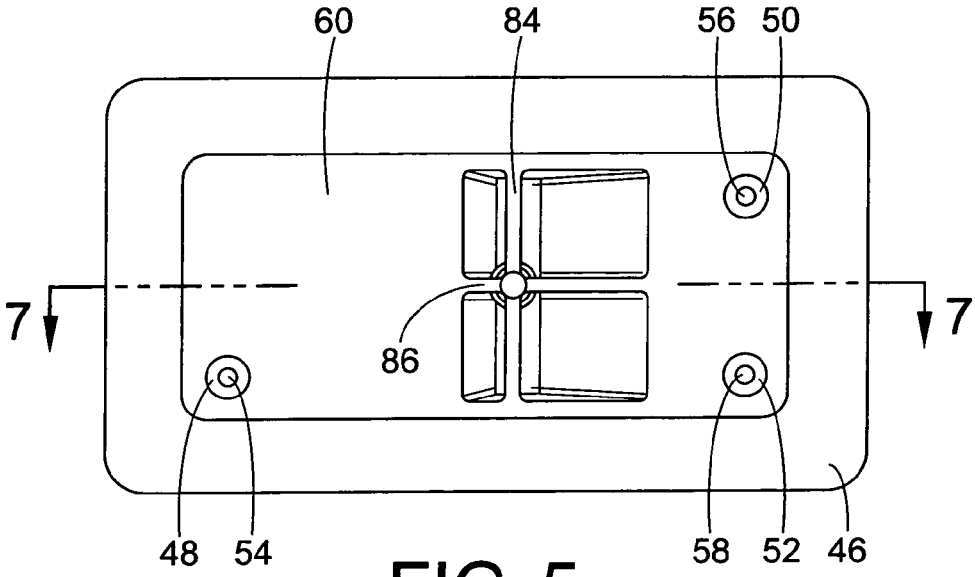
FIG. 5 is a bottom plan view of the ink container lid of FIG. 3.

As noted above, the connecting posts 48, 50, 52 engage the plurality of holes 36, 38, 40 in the spacer 16 in a nonhermetic fashion. In a preferred embodiment of the invention, this is accomplished by forming within each connecting post at least one gas flow opening 54, 56, 58, respectively, as shown in FIGS. 5 and 6. The gas flow openings provide for gas flow communication between the first and second sides of the spacing member while the container lid is fixedly connected to the spacing member.

A recess 60 is formed in side 46 of the lid to provide a space or gap for allowing equalization of gas pressure within the cavities. That is, due to the gas flow openings, the pressure inside the cavities of the ink container remains substantially equal to that outside of the container even after a substantial portion of the ink volume has been used and consumed. Thus, there are fewer problems with ink flow due to pressure inequalities inside and outside of the ink container body 12. The gas flow channels are dimensioned to be large enough to equalize the gas pressure inside the cavities of the container body 12 and are small enough to minimize leakage, spillage or evaporation of ink through the gas flow openings.

The connection posts can also be made of deformable material to facilitate installing the lid onto the spacing member. This allows the connecting posts to more firmly engage the holes in the spacing member 16. The container lid 18 and its connecting posts 48, 50, 52 may be formed from a wide range of materials by a variety of methods similar to those described for the ink container body 12 and the spacer 16.

Figure 7:
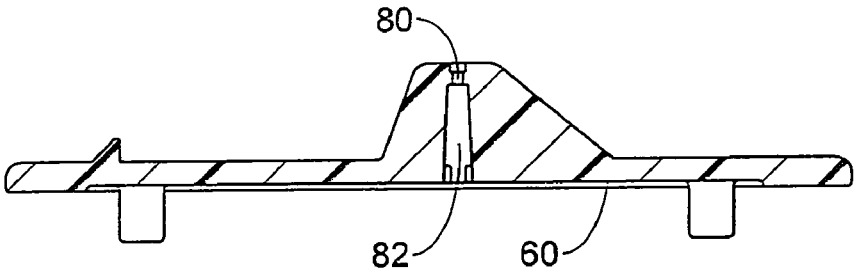
FIG. 7 is a side elevational view, in cross section, of the ink container lid of FIG. 3.
Figure 8:
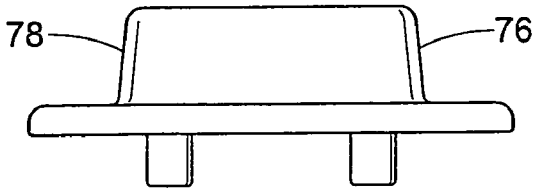
FIG. 8 is a front elevational view of the ink container lid of FIG. 3.
Figure 9:
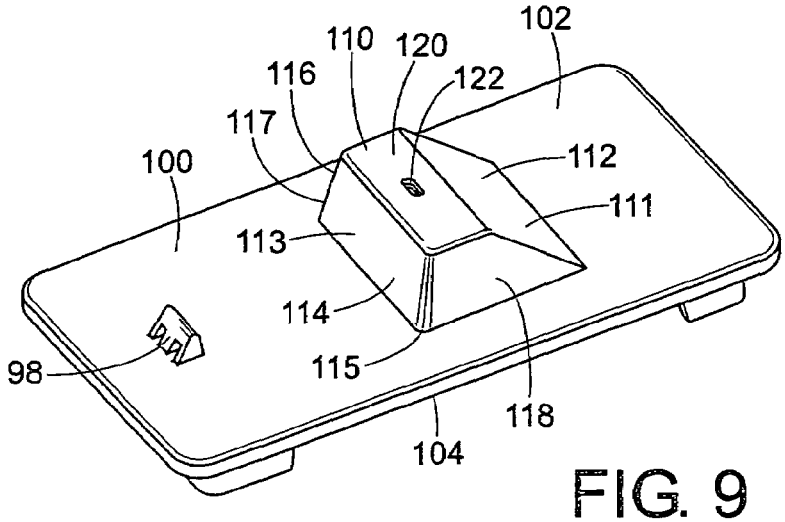
FIG. 9 is a perspective view of an ink container lid in accordance with a second embodiment of the present invention.

Referring now to FIGS. 3-8, in accordance with a first embodiment of the present invention, the lid or cover 18 has a raised portion 70 which has angled first and second end walls 72, 74 on opposite sides of the raised portion. A tab 69 which engages a corresponding indexing portion of the printer also extends from side 44. Third and fourth side walls 76, 78 are formed on opposite sides and connect walls 72, 74 together. Referring to FIG. 8, walls 76, 78 have a slight angle of approximately 10° from vertical which extends along the length of each side wall 76, 78. Referring to FIGS. 4 and 7, first end wall 72 has an obtuse angle of approximately 140° from horizontal or from planar side 44. Second end wall 74 has an obtuse angle of approximately 110° from horizontal or from planar side 44. The first and second walls each has a solid planar face 71, 77 respectively, the entirety of which extends between the third and fourth walls and to a top wall 79. Top wall 79 is substantially parallel to planar side 44. The second wall has edges 73, 75 which extend to the third and fourth walls, respectively. The second end wall is conformed so that the lid can be installed into and used with various manufacturers' printers. That is, the second wall eliminates end portions or keying features which are formed on existing lids so that the cartridges can only be used and installed with OEM printers. For example, some of the existing ink container lids have cut-out portions or slots for engaging portions of a printhead during installation of the ink cartridge. Other lids have straight and angled walls formed on a second end wall of the raised portion. The second end wall 74 of the raised portion eliminates the keying features.

Top wall 79 is formed between end walls 72, 74 and has a vent hole 80 formed therein to allow the internal ink chamber to be vented to ambient atmosphere. A venting chamber 82 is formed through the lid body between top wall 79 and bottom wall 46. Referring to FIG. 5, bottom wall of the lid has groove or channel 84 which is formed within recess 60 along a longitudinal axis of the lid. A second groove or channel 86 is formed within recess 60 substantially normal to groove 84. Grooves 84, 86 intersect adjacent the venting hole 80. The gas flow openings are also fluidly connected to the venting hole 80 via recess 60 and allow the gas pressure inside the cavities of the container to be equalized.

Figure 10:
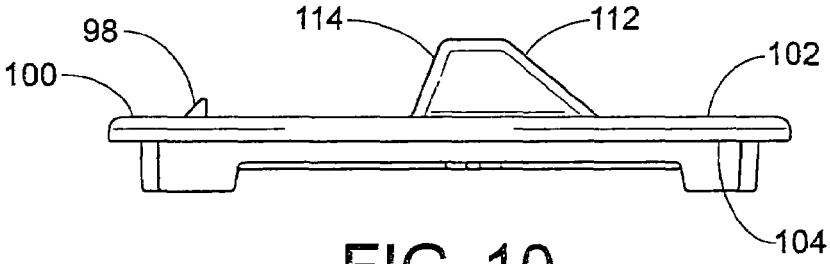
FIG. 10 is a side elevational view of the ink container lid of FIG. 9.
Figure 11:
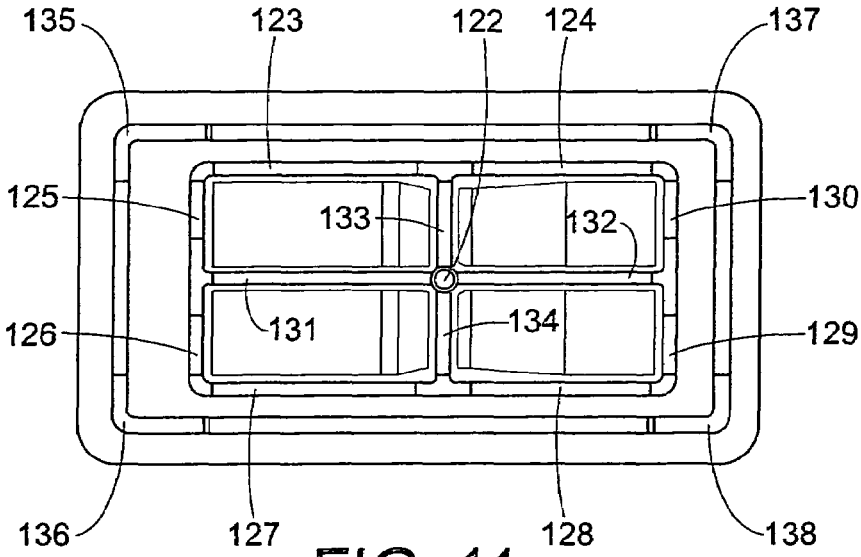
FIG. 11 is a bottom plan view of the ink container lid of FIG. 9.
Figure 12:
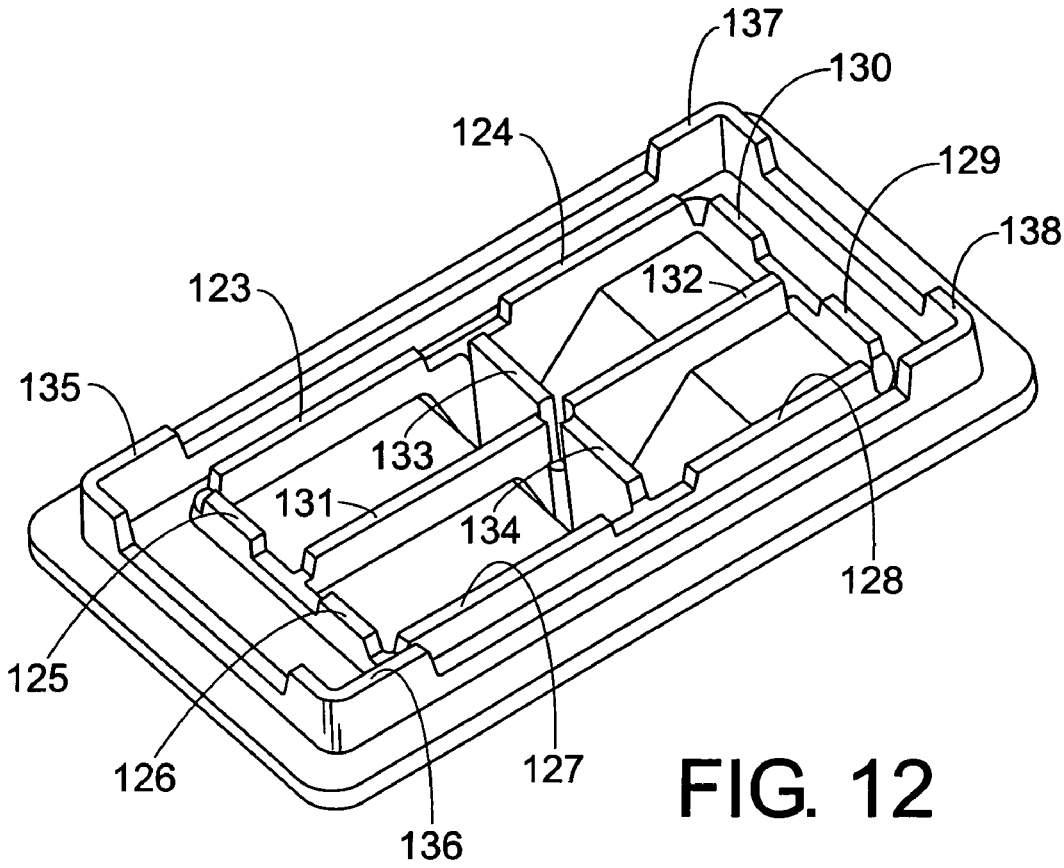
FIG. 12 is a bottom perspective view of the ink container lid of FIG. 9; and, FIG. 13 is a side elevational view, in cross section, of the ink container lid of FIG. 9.
Figure 13:
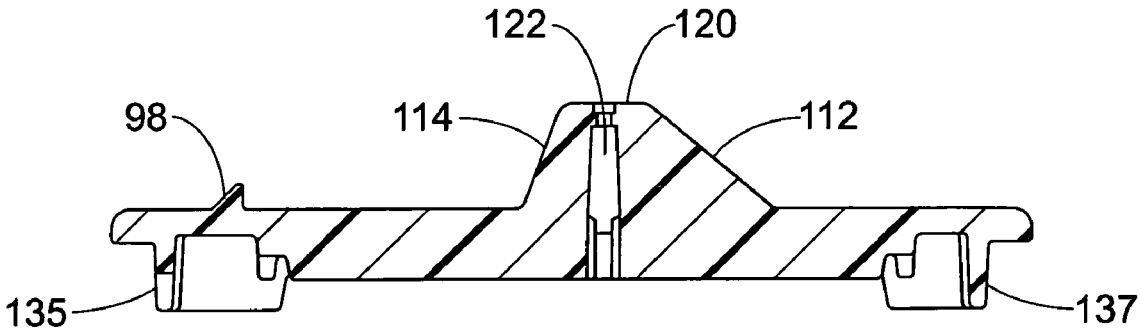

Referring now to FIGS. 9-13, an ink cartridge lid 100 in accordance with a second embodiment is shown. Lid 100 is used with an ink container having a single open-ended cavity and a single foam insert or ink absorbing member to be used with black ink. Otherwise, the container is substantially the same as shown and discussed in FIGS. 1 and 2. As with the lid of the first embodiment, the lid has a generally planar first side 102 and second side 104. The lid or cover also has a raised portion 110 which has angled first and second end walls 112, 114 on opposite sides of the raised portion. Tab 98 also extends from first side 102. Third and fourth side walls 116, 118 are formed on opposite sides also and connect walls 112, 114 together. Side walls 116, 118 have a slight angle of about 10° from vertical which extends along the length of each side wall. Referring to FIG. 10, first end wall 112 has an angle of approximately 140° from horizontal. Second end wall 114 has an angle of approximately 110° from horizontal. The first and second walls each has a solid planar face 111, 113 which extends between the third and fourth walls. Second wall 114 has edges 115, 117 which extend to walls 116, 118, respectively. As with the lid of the first embodiment, the second end wall is conformed so that the lid can be installed into and used with various manufacturers' printers. The second end wall eliminates second end portions or keying features which are formed on existing lids so that the cartridges can only be used and installed with OEM printers.

A top surface or wall 120 formed between end walls has a vent hole 122 formed therein to allow the internal ink chamber to be vented to ambient atmosphere. The bottom wall of the lid has a plurality of projections in the form of ribs 123, 124, 125, 126, 127, 128, 129 and 130 which are arranged to extend into and compress the ink absorbing member adjacent the vent opening. The ribs also assist in venting the ink container cavity and ink absorbing member to atmosphere. Ribs 131, 132, 133, and 134 are formed in a central portion of the lid and intersect to form a "t" shaped cross-section surrounding vent opening 122. Substantially L-shaped ribs 135, 136, 137, 138 are formed adjacent outer edges of the lid. Ribs 123, 124, 127, 128 are shown to be longer than ribs 125, 126, 129, 130, but other dimensions can be used without departing from the scope of the invention.

The exemplary embodiments have been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. An ink jet cartridge lid, comprising:

a body having a first planar side;

a second planar side opposite said first planar side;

wherein said first planar side comprises a raised portion having a first angled end wall and a second angled end wall opposite said first angled end wall; and a recessed portion formed on said second planar side;

a third side wall and a fourth side wall, each of which connects said first angled end wall to said second angled end wall; and a tab located on said first planar side and spaced from said raised portion for engaging a portion of an associated printer, wherein said first angled end wall has an obtuse angle of 140°±5° extending from said first planar side.

2. The lid of claim 1, wherein said third and fourth side walls each has an angle of 10°±2° from a vertical plane extending along a length of said third and fourth side walls.

3. The lid of claim 1, further comprising a top wall extending between said first and second angled end walls, said top wall being substantially parallel to said first planar side, a length of said top wall being smaller than a length of said first angled wall.

4. The lid of claim 3, wherein said top wall comprises a vent opening therein.

5. The lid of claim 1, further comprising a plurality of connecting posts extending from said second planar side, each connecting post being located in said recessed portion.

6. The lid of claim 5, wherein said connecting posts each comprises a gas flow opening extending through each of said posts.

7. The lid of claim 6, further comprising a plurality of passages formed adjacent a vent opening in said lid, said passages are formed in said recessed portion of said lid and connect said gas flow openings of said connecting posts to said vent opening in said lid, at least two passages of said plurality of passages intersect.

8. The lid of claim 1, wherein said second planar side comprises a plurality of ribs extending from said second planar side.

9. The lid of claim 8, wherein a first portion of said ribs are formed in a generally L-shaped conformation adjacent outer edges of said lid.

10. The lid of claim 9, wherein a second portion of said ribs form a generally T-shaped conformation, said first portion of said ribs at least partially surrounding said second portion of said ribs.

11. The lid of claim 8, wherein a portion of said ribs are parallel to each other.

12. The lid of claim 8, wherein a portion of said ribs are perpendicular to each other.

13. The lid of claim 8, wherein a vent opening is formed in said second planar side interposed between said ribs.

14. An ink jet cartridge lid, comprising:

a body having a first planar side;

a second planar side opposite said first planar side;

wherein said first planar side comprises a raised portion having a first angled end wall and a second angled end wall opposite said first angled end wall; and a recessed portion formed on said second planar side;

a third side wall and a fourth side wall, each of which connects said first angled end wall to said second angled end wall;

wherein said second angled end wall has an obtuse angle of 110°±5° extending from said first planar side, said angle extends between said third and fourth side walls; and a tab located on said first planar side and spaced from said second angled end wall for engaging a portion of an associated printer.

15. The lid of claim 14, wherein said second angled end wall comprises a planar surface, wherein an entirety of said planar surface extends between said third and fourth side walls.

16. The lid of claim 14, wherein said second angled end wall has a first edge and a second edge, wherein first edge extends to said third side wall and said second edge extends to said fourth side wall and said first and second edges extend to a top surface of said raised portion.

17. An Ink jet printer cartridge comprising:

an ink container body having a bottom wall and a plurality of side walls, said side walls each having a top wall edge;

said bottom wall and said side walls together form a cavity; and, a lid having a body having a first planar side and a second planar side opposite said first planar side;

wherein said first planar side comprises a raised portion having a first angled end wall and a second angled end wall wherein each of said end walls has an obtuse angle extending from said first planar side, and a top wall extending between said end walls, said top wall having a vent opening therein; wherein said lid first angled end wall has an obtuse angle of 140° from said first planar side of said lid;

a tab located on said first planar side for engaging a portion of an associated printer; and at least one projection extending from said second planar side, said at least one projection at least partially extending into said cavity.

18. The cartridge of claim 17, wherein said lid further comprises a third side wall and a fourth side wall, each of which connects said first angled end wall to said second angled end wall.

19. The cartridge of claim 17, wherein said at least one projection of said second planar side of said lid comprises a plurality of ribs extending from said second planar side.

20. The cartridge of claim 19, wherein a first portion of said ribs of said lid are formed in a generally L-shaped conformation adjacent outer edges of said lid.

21. The cartridge of claim 20, wherein a second portion of said ribs of said lid form a generally T-shaped conformation, said first portion of said ribs at least partially surrounding said second portion of said ribs.

22. The cartridge of claim 19, wherein a portion of said ribs are parallel to each other.

23. The cartridge of claim 19, wherein a portion of said ribs are perpendicular to each other.

24. The cartridge of claim 19, further comprising an ink absorbing member disposed in said cavity of said cartridge, wherein said ink absorbing member is compressed by said ribs extending from said second planar side.

25. The cartridge of claim 17, wherein said second angled end wall of said lid comprises a planar surface, wherein an entirety of said planar surface extends between said third and fourth side walls of said raised portion of said lid.

26. The cartridge of claim 17, wherein said second angled end wall of said lid has a first edge and a second edge, wherein said first edge extends to said third side wall and said second edge extends to said fourth side wall and said first edge and said second edge extend to a top surface of said raised portion of said lid.

27. An Ink jet printer cartridge comprising:

an Ink container body having a bottom wall and a plurality of side walls, said side walls each having a top wall edge;

said bottom wall and said side walls together form a cavity; and, a lid having a body having a first planar side and a second planar side opposite said first planar side;

wherein said first planar side comprises a raised portion having a first angled end wall and a second angled end wall wherein each of said end walls has an obtuse angle extending from said first planar side, and a top wall extending between said end walls, said top wall having a vent opening therein; wherein said lid second angled end wall has an obtuse angle of 110° from said first planar side of said lid;

a tab located on said first planar side for engaging a portion of an associated printer; and at least one projection extending from said second planar side, said at least one projection at least partially extending into said cavity.

28. The cartridge of claim 27, wherein said at least one projection of said lid comprises a plurality of connecting posts extending from said second planar side of said lid.

29. The cartridge of claim 28, further comprising a spacing member having a first wall and a second wall opposite to each other and a plurality of holes extending through said first wall and said second wall, said holes matingly receive said connecting posts of said lid.

30. The cartridge of claim 28, wherein said connecting posts of said lid each comprises a gas flow opening extending through each of said posts.

31. The cartridge of claim 30, wherein said lid further comprises a recessed portion formed in said second planar side, and a plurality of passages formed adjacent a vent opening in said lid, said passages are formed in said recessed portion of said lid.

* * * * *